US005898240A

United States Patent [19]

Tsou

[11] Patent Number: 5,898,240

[45] Date of Patent: Apr. 27, 1999

[54] TIMING CONTROL SWITCH

[76] Inventor: Yeong Haw Tsou, 9515 E. Naomi Ave., Arcadia, Calif. 91007

[21] Appl. No.: 08/814,083

[22] Filed: Mar. 10, 1997

[51] Int. Cl.[6] ..... H01H 7/00

[52] U.S. Cl. ..... 307/141

[58] Field of Search ..... 307/141, 141.4, 307/141.8, 119; 388/921; 74/568 T; 91/35; 200/27 B

[56] References Cited

U.S. PATENT DOCUMENTS

| | | | |
|---|---|---|---|
| 5,397,930 | 3/1995 | Nilssen | 307/141.4 |
| 5,530,301 | 6/1996 | Fu et al. | 307/141 |
| 5,719,362 | 2/1998 | Gray, Jr. | 307/141 |

*Primary Examiner*—Richard T. Elms
*Attorney, Agent, or Firm*—Raymond Y. Chan; David & Raymond

[57] ABSTRACT

A timing control switch includes a timer control device and at least a timer adapter electrically connected with an easy accessible and convenient position of an electrical cord of an electrical appliance. The timer adapter has a receiving chamber, two electrical terminals for electrically connecting with two broken ends of the electrical cord, and a movable conducting device with a contact element which is normally kept in contact with the two electrical terminals. The timer control device includes a timer control circuitry for timing control, a connector with two electrical conduct elements, a driving device for driving a driver to move in linear direction so as to drive a connecting bridge electrically connected or disconnecting with the two conduct elements, and battery for providing power supply to the timer control circuitry and the driving device. Whereby when the connector of the timer control device is plugged into the receiving chamber of the timer adapter, the movable conducting device will be driven to drive its electrical contact element disconnected with the two electrical terminals. Therefore, the electrical appliance can be controlled by the timer control device to power on or off at preset time on or time off schedule in the timer control device.

13 Claims, 5 Drawing Sheets

TIMING CONTROL SWITCH

BACKGROUND OF THE PRESENT INVENTION

This is a regular application of a provisional application, application Ser. No. 60/030,883, filed Oct. 31, 1996. The present invention relates to a digital timer control device with timer-ready module, and more particularly to a timing control switch which may be equipped with every electrical cord, extension cord, plug, outlet, and wall switch to turn on and off of the lights, appliances and the like at specific times set.

In today's society, most people have fixed schedule on weekdays. People get up each morning, fix some breakfast and a hot cup of coffee, and then they go off to work. They do this for every working day. With the technology available today, many things can be automated for the convenience of people. These things include the coffee machine being turned on at 7:00 o'clock in the morning for preparing a nice hot coffee, water sprinkler being turned on at 8:00 o'clock to water the plant and lawn, home alarm system being turned on at 8:05 when all residents are out for school or work. At night time, the front door light prefers to be turned on at sunset. The stereo system and lighting device can even be preset to turn on to prevent the intrusion of theft for that theft might think that there are people in the house. At midnight, all the lights and appliances can be set to turn off to preserve electrical energy and safe money. Besides, people may often forget to turn off the electrical office appliances, such as the copy machine, air conditioner, and audio system, before they leave the office. It is also a major reason of the need of timer control for most office appliances.

Although the conventional timer device comprises built-in and costly electronic parts, it still has the following disadvantages:

First, the conventional timer device needs a human controller present to switch on and off Furthermore, most of the conventional timer devices do not set time exceeding one hour so that when the human operator set the time for doing certain task, he or she will need to come back and reset the timer devices after an hour.

Second, the conventional timer devices are usually installed at the wall socket outlet. However, after a house is decorated with furniture, some of the wall socket outlets might be located behind some heavy furniture or underneath some tables that make the conventional timer devices not easily accessible.

A most essential shortcoming of the conventional timer device is that the conventional timer device works independently, so that each appliance must install a specific timer device. It is very costly that the user must install as many timer devices as the total number of the appliances which need timer control. However, it is rare for the user to operate all the appliances at the same time.

SUMMARY OF THE PRESENT INVENTION

It is a main objective of the present invention to provide a timing control switch comprising a battery-operated timer control device which may be functioned by selectively plugging into any one of a plurality of special designed timer adapters which are electrically equipped with the electrical cords of appliances, extension cords, plugs of appliances, socket outlets, or wall switches respectively, so as to turn lights, appliances and the like on and off at specific times preset.

It is another objective of the present invention to provide a timing control switch which timer adapter may be preset on any easy-accessible and convenient location along the electrical cord, outlet, or wall switch of an appliance. Therefore, the timer control device of the present invention can be easily plugged to or unplugged from any timer adapter connected to an easy-accessible and convenient location along the electrical cord. Moreover, people do not have to move furniture or crawl under table to find the outlet behind which happened in most cases if using the conventional timer device.

It is still another objective of the present invention to provide a timing control switch, in which the timer control device thereof can be easily switched to one and another timer adapters where needed.

It is still another objective of the present invention to provide a timing control switch that when it is not used as a timer control purpose, it can be used as a digital clock and alarm/clock unit.

It is still another objective of the present invention to provide a timing control switch, wherein the battery-operated timer control device thereof will not be affected in electrical power failure which normally will mess up the preset time of the conventional timer device or AC powered timer unit, because the timer control device of the present invention comprises a battery as its power source.

Accordingly, the timing control switch of the present invention comprises a batteryoperated digital timer control device and at least a special designed timer adapter which is electrically connected to an electrical cord, electrical extension cord, electrical outlet, or electrical wall switch.

The timer control device comprises a housing, a DC power source, a timer control circuitry, a driving device, a driver, a connecting bridge, and a connector. The DC power source is disposed inside the housing for providing electrical power for the timer control circuitry and the driving device. The connector comprises a pusher and a first and a second electrical conducting element extended outwardly and independently from a connecting end of the housing. The timer control circuitry is disposed inside the housing for time presetting and computing. The driving device is installed inside the housing and electrically connected with the timer control circuitry. The connecting bridge is disposed inside the housing and has an electrical conductive connecting plate having a length at least equal to the distance between the first conduct element and the second conduct element. The driver is connected between the driving device and the connecting bridge. When a preset on-time in the timer control circuitry is up, the timer control circuitry generates a connecting signal to activate the driving device to drive the driver toward the first and second conducting elements so as to press the connecting plate of the connecting bridge to electrically connect between the first conducting element and the second conducting element. When a preset off time in the timer control circuitry is up, the timer control circuitry generates a disconnecting signal to activate the driving device to drive the driver away from the first and second conduct elements so as to draw the connecting plate of the connecting bridge to electrically disconnect with the first conducting element and the second conducting element.

The timer adapter comprises a case which has a receiving chamber for receiving the connector of the timer control device, a first and a second electrical terminal provided inside the case for electrically connecting with two electrical cord ends of an electrical appliance respectively, a first and a second electrical conductive contact plate extending from the first and the second electrical terminal to the receiving chamber respectively, and a movable conducting means which is disposed within the receiving chamber and comprises an electrical conductive elongated contact element normally in contact with the first and second contact plates. The timer control device is fittedly and electrically connected with the timer adapter by inserting the connector of timer control device into the receiving chamber of the timer adapter, wherein the pusher of the timer control device pushes the movable conducting means away from the first and second contact plates so as to disconnect the electrical connection between the elongated contact element and the first and second contact plates. At the same time, the first and the second conducting element of the connector of the timer control device are electrically in contact with the first and the second contact plate respectively.

DETAILED DESCRIPTION OF THE PREFERRED EMBODIMENT

Figure 3:
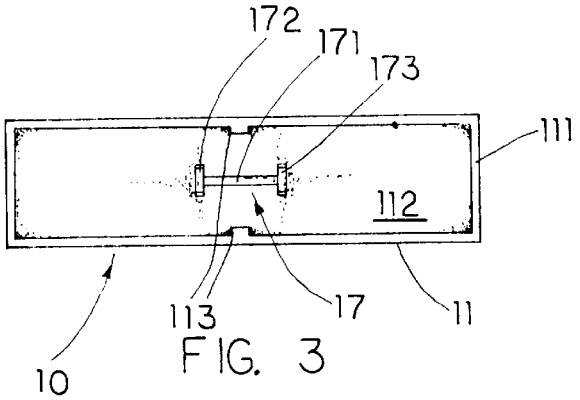
FIG. 3 is a bottom view of the timer control device of the timing control switch according to the above preferred embodiment of the present invention.
Figure 4:
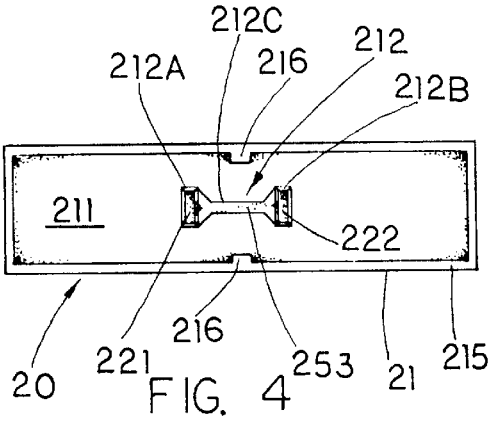
FIG. 4 is a top view of the timer adapter of the timing control switch according to the above preferred embodiment of the present invention.
Figures 5, 6:
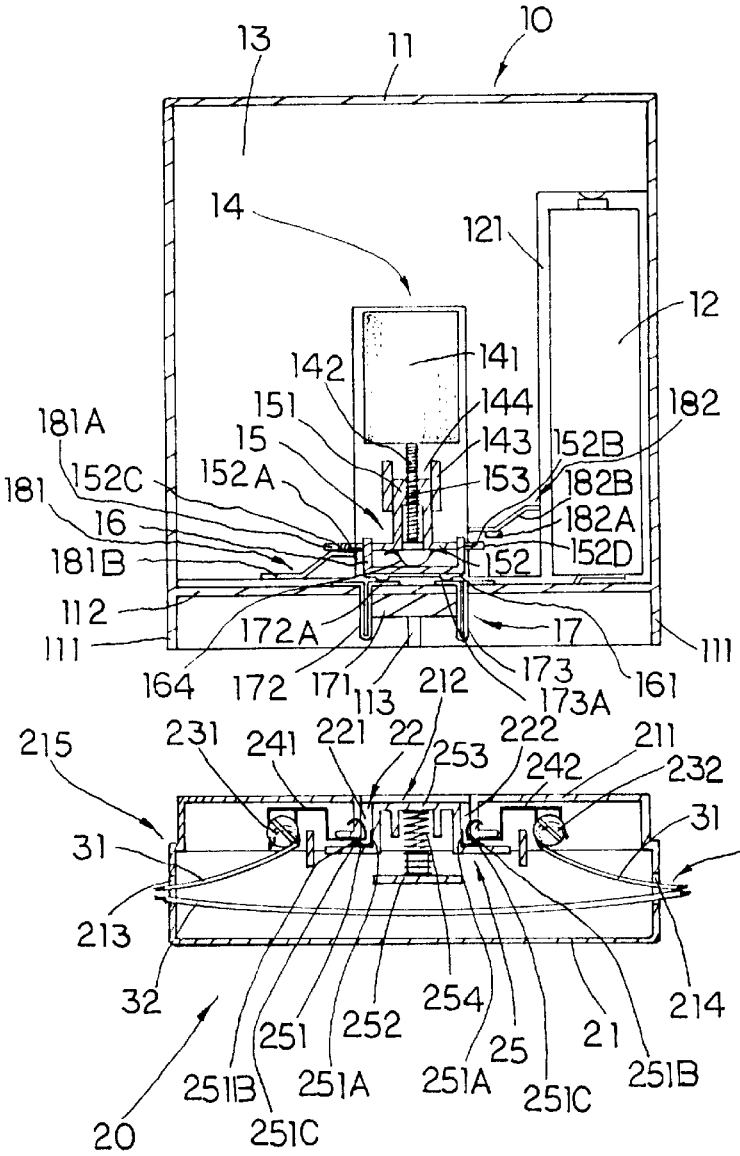
FIG. 5 is a sectional front view of the timing control switch according to the above preferred embodiment of the present invention, wherein the timer control device is detached from the timer adapter.
FIG. 6 is a sectional side view of the timing control switch according to the above preferred embodiment of the present invention, wherein the timer control device is detached from the timer adapter.

Referring to FIGS. 1 to 8 of the drawings, a timing control switch of the present invention comprises a battery-operated digital timer control device 10 and at least a special designed timer adapter 20 which is electrically connected to an electrical cord 30 of an electrical appliance (as shown in FIG. 5).

The timer control device 10 comprises a housing 11, a DC power source 12, a timer control circuitry 13, a driving device 14, a driver 15, a connecting bridge 16, and a connector 17. The housing 1 has a peripheral holding wall 111 peripherally extended from a connecting end 112 of the housing 11. Two guiding ribs 113 are longitudinally protruded from the central positions of the two long sides of the holding wall 111 respectively.

Referring to FIGS. 5 and 6, the DC power source 12 is disposed inside the housing 11 for providing electrical power for the timer control circuitry 13 and the driving device 14. The timer control circuitry 13 comprises a printed circuit board disposed inside the housing for time presetting and computing.

Figure 1:
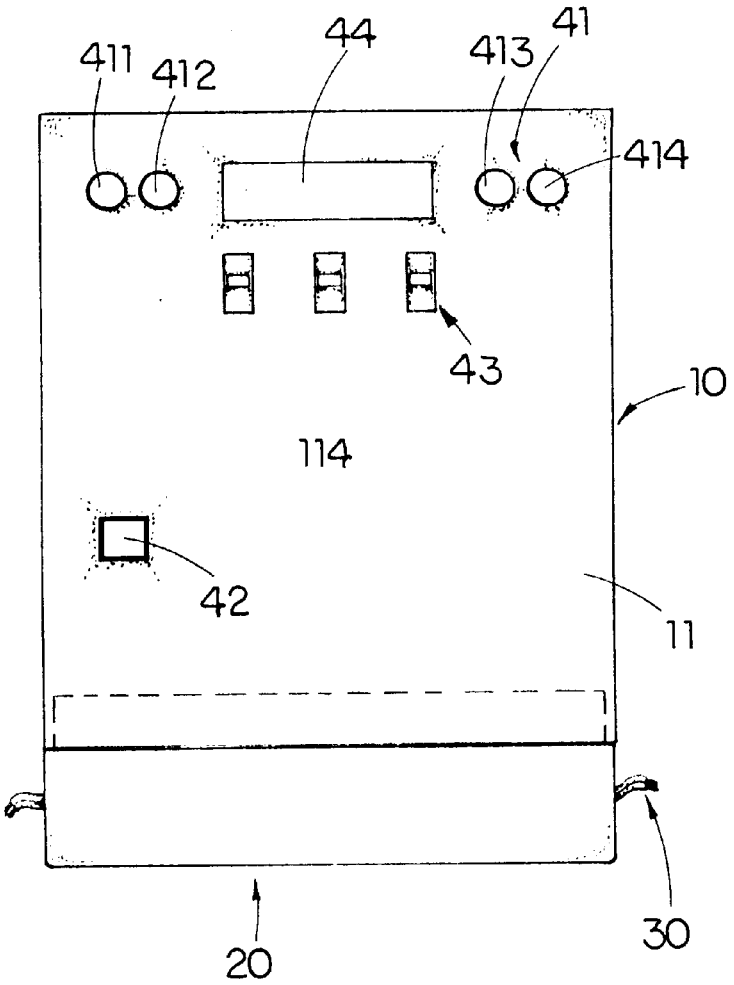
FIG. 1 is a front view of a timing control switch according to a preferred embodiment of the present invention, wherein the timer control device is connected with the timer adapter.
Figure 2:
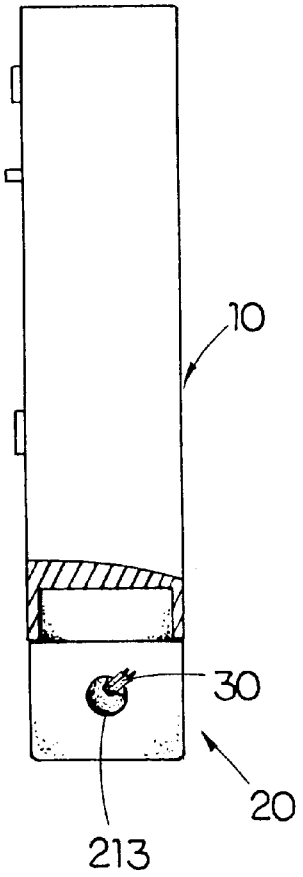
FIG. 2 is a side view of the timing control switch according to the above preferred embodiment of the present invention, wherein the timer control device is connected with the timer adapter.

As shown in FIG. 1, on a front surface 114 of the housing 111 of the battery operated digital timer control device 10 provides a set of setting buttons 41 for time setting and adjusting, a manual override button 42 for manually turning the lighting or the appliance on or off when the timer control device 10 is plugged into the timer adapter 20, three time-on and time-off set switches 43 which allow for setting one, two and three events of "on time" and "off time", and a timer screen 44 for displaying the current time and the presetting time. The switches 43 for setting the events are not limit to just three that, when more events need to be set, the number of the switches 43 can also be increased or decreased to meet the desired requirement.

The set of setting buttons 41 further comprises a timer on/off button 411, an alarm button 412, an hour button 413, and a minute button 414 positioned on the front surface of the housing 11 at a predetermined location near the timer screen 44. The set of the setting buttons 41, the manual override button 42 and the three sets of time-on & time-off set switches 43 are electrically connect to the timer control circuitry 13.

Referring to FIGS. 3, 5 and 6, the connector 17 comprises a pusher 171 and a first and a second electrical conducting element 172, 173 extended outwardly and independently from the connecting end 112 of the housing 11. According to the present embodiment, the first and second conducting elements 172, 173 are two electrical conductive plug blades parallelly affixed to the connecting end 112 of the housing 11. Each of the first and second conducting elements 172, 173 has a contact lip 172*a*, 173*a* transversally extended on the inner surface of the connecting end 112. The pusher 171 is a rectangular rib protruded from the connecting end 112 between the two conduct elements 172, 173.

Figure 8:
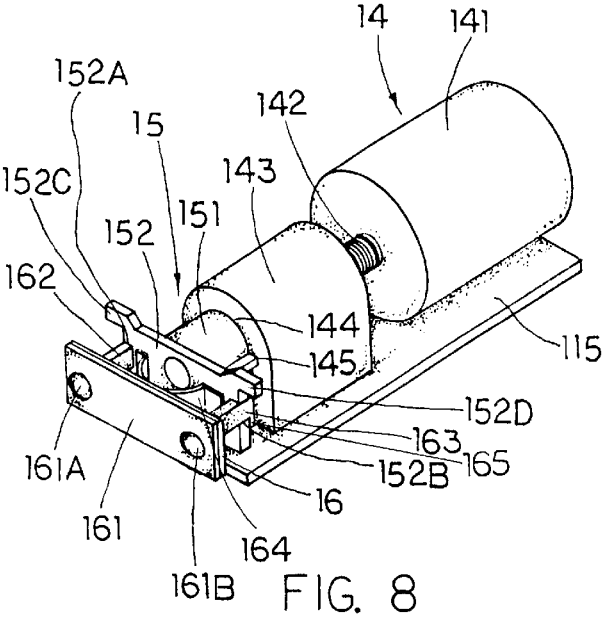
FIG. 8 is a perspective view of the driving device, the driver and the connecting bridge of the timing control switch according to the above preferred embodiment of the present invention.

Referring to FIGS. 5, 6 and 8, the driving device 14 is installed inside the housing 11 and electrically connected with the timer control circuitry 13. The connecting bridge 16 is disposed inside the housing 11 and has an electrical conductive connecting plate 161 having a length at least equal to the distance between the first conducting element 172 and the second conducting element 173. The driver 15 is connected between the driving device 14 and the connecting bridge 16. When a preset on-time in the timer control circuitry 13 is up, the timer control circuitry 13 generates a connecting signal to activate the driving device 14 to drive the driver 15 toward the first and second conducting elements 172, 173 so as to press the connecting plate 161 of the connecting bridge 16 to electrically connect between the first conducting element 172 and the second conducting element 173. When a preset off time in the timer control circuitry 13 is up, the timer control circuitry 13 generates a disconnecting signal to activate the driving device 14 to drive the driver 15 away from the first and second conducting elements 172, 173 so as to draw the connecting plate 161 of the connecting bridge 16 to electrically disconnect with the first conducting element 172 and the second conducting element 173.

As shown in FIGS. 5, 6, 7, and 8, the driving device 14 comprises a reversible electrical DC motor 141 affixed on a mounting board 115 of a side wall of the housing 11, an output gear shaft 142 extended from the DC motor 141, and a guiding holder 143 affixed on the mounting board 115. In operation, the rotation of the gear shaft 142 is driven by the small reversible DC motor 141 which is powered by the battery 12. The action of the small reversible DC motor 141 is controlled by the timer control circuitry 13, to which the motor 141 is electrically connected.

Figure 7:
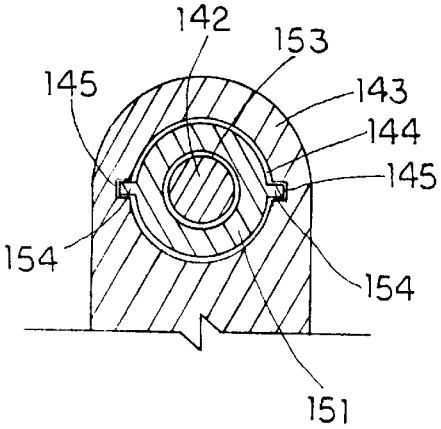
FIG. 7 is a sectional end view of the driving device and the driver of the timing control switch according to the above preferred embodiment of the present invention.

The guiding holder 143 has a guiding channel 144 aligned coaxially with the gear shaft 142. The guiding channel 144 has two axial side slots 145 respectively provided on two opposite sides thereof The driver 15 comprises a driver shaft 151 and a driver seat 152. The driver shaft 151 is penetrated through the guiding channel 144. The driver seat 152 is affixed to a first end of the driver shaft 151 for loosely interlocking with the connecting bridge 16. A second end of the driver shaft 151 has an axial gear hole 153 engaging with the gear shaft 142 of the driving device 14. The driver shaft 151 protrudes two opposite longitudinal side guiders 154 slidably wedging along the two side slots 145 of the guiding holder 143 respectively (as shown in FIG. 7). When the DC motor 141 turns the gear shaft 142 to rotate, the circular movement of the gear shaft 142 is transformed into linear movement of the driver 15. Therefore, the driver shaft 151 and the driver seat 152 of the driver 15 can be driven by the rotating gear shaft 142 to move forward or rearward in linear direction because the guiding holder 143 provides supporting for the driver shaft 151 and prevents any rotation of the driver shaft 151.

Referring to FIGS. 5 and 8, the driver seat 152 provides two recesses 152*a*, 152*b* at two ends thereof The connecting bridge 16 further comprises two guiding posts 162, 163 extended through the two recesses 152*a*, 152*b* of the driver seat 152 respectively, as shown in FIG. 8. A spring element 164 is positioned between the driver seat 152 and the connecting bridge 16 for providing a pressing force on the connecting bridge 16 so as to ensure the best electrical contact between the connecting plate 161 and the first and second conducting elements 172, 173 (as shown in FIG. 5). As shown in FIG. 8, each of the guiding posts 162, 163 has an enlarged end portion 165 to limit the maximum distance between the driver seat 152 and the connecting bridge 16. For better electrical conduction, the connecting plate 161 further has two contact points 161*a*, 161*b* protruded therefrom for contacting with the first and second conducting elements 172, 173 respectively.

Referring to FIG. 5, in order to control the forward and rearward displacement of the driver 15, the timer control device 10 further comprises a first and a second power interrupter 181, 182 which can be two contact switches. According to the present embodiment, each the first and second power interupters 181, 182 comprises a contact point 181*a*, 182*a* and a metallic elastic strip 181*b*, 182*b*. The first elastic strip 181*b* of the first power interrupter 181 is attached to the inner surface of the connecting end 112 of the housing 11. The second elastic strip 182*b* of the second power interrupter 182 is attached to a battery case 121 of the battery 12 above the connecting end 112 of the housing 11 so as to define a predetermined distance between the first and the second power interrupter 181, 182. The first and second contact points 181*a*, 182*a* are positioned adjacent to the first and second elastic strips 181*b*, 182*b* respectively, so as to enable the two first and second elastic strips 181*b*, 182*b* normally in electrical contact with the the first and second contact points 181*a*, 182*a* respectively. As shown in FIGS. 5 and 8, the driver seat 152 of the driver 15 further has a first and a second prong 152*c*, 152*d* protruded outwardly from the two ends of the driver seat 152.

Therefore, when the driver seat 152 and the driver shaft 151 are driven to move forward by the rotating gear shaft 142, which is driven to rotate, for example, in counterclockwise direction by the DC motor 141, until the first prong 152*c* pushes the first elastic strip 181*b* of the first power interrupter 181 away from and to disconnect with the first contact point 181*a*, the DC motor 141 will stop and the driver 15 will remain in a low position to keep the two contact points 161*a*, 161*b* of the connecting plate 161 in contact with the first and second conduct elements 172, 173 and therefore the electricity can go through. However, when the driver 15 is driven to move rearward by the rotating gear shaft 142, which is driven to rotate, for example, in clockwise direction by the motor 141, until the second prong 152*d* pushes the second elastic strip 182*b* of the second power interrupter 182 away from and to disconnect with the second contact point 182*a*, the DC motor 141 will stop and the driver 15 will remain in an up position to keep the connecting plate 161 disconnecting with the first and second conducting elements 172, 173 until a next preset on-time.

Referring to FIG. 5, the timer adapter 20 comprises a case 21 which has a receiving chamber 22 for receiving the connector 17 of the timer control device 10, a first and a second electrical terminal 231, 232 provided inside the case 21 for electrically connecting with two ends of the electrical cord 30 of an electrical appliance respectively, a first and a second electrical conductive contact plate 241, 242 extending from the first and the second electrical terminal 231, 232 to the receiving chamber 22 respectively, and a movable conducting means 25 which is disposed within the receiving chamber 22 and comprises an electrical conductive elongated contact element 251 which is normally in contact with the first and second contact plates 241, 242.

As shown in FIGS. 5 and 6, the conducting means 25 comprises a supporting wall 252 transversally extended from a side wall of the case 21, a push cap 253 normally disposed within the receiving chamber 22, and a coil spring 254 connected between the supporting wall 252 and the push cap 253. As shown in FIG. 5, the contact element 251 comprises a ring portion 251*a* retained on the push cap 253 and two end terminals 251*b*, 251*c* extended from the ring portion 251*a*. Normally, the push cap 253 is propped up by means of the coil spring 254 to ensure the two end terminals 251*b*, 251*c* being in good contact with the bottom surfaces of the first and second contact plates 241, 242 respectively. The propping up push cap 253 also covers the receiving chamber 22 and defines two side sockets 221, 222 between two side walls of the receiving chamber 22 and the push cap 253, as shown in FIGS. 4 and 5.

Referring to FIGS. 4 to 6, on a top wall 211 of the case 21, a I-shaped opening 212 is provided thereon, which has two end holes 212*a*, 212*b* linked to the two side sockets 221, 222 respectively and a central rectangular hole 212*c* positioned between the two end holes 212*a*, 212*b* (as shown in FIG. 4). The two side sockets 221, 222 are adapted for receiving the first and second conducting elements 172, 173 of the timer control device 10 via the two end holes 212*a*, 212*b* respectively. The central rectangular hole 212*c* has a length and a width slightly larger than or equal to that of the pusher 171 of the connector 17 of the timer control device 10, so that the pusher 171 may penetrate the central rectangular hole 212*c* and downwardly push on the push cap 253 to drive the contact element 251 downward and disconnect with the first and second contact plates 241, 242 when the two conducting elements 172, 173 are inserted into the two side sockets 221, 222.

As shown in FIG. 5, the case 21 has two access holes 213, 214 formed at two side walls of the case 21 respectively to enable the wires of an electrical cord 30 to insert into the timer adapter 20. As shown in FIGS. 4 to 6, a peripheral receiving recess 215 is formed around the top wall 211 of the case 21, so that the holding wall 111 of the housing 11 of the timer control device 10 can be sat on the peripheral receiving recess 215 to firmly support the timer control device 10 on the timer adapter 20 when the connector 17 of the timer control device 10 is inserted into the receiving chamber 22 of the timer adapter 20. Moreover, as shown in FIG. 4, two indented slots 216 are formed on the central portions of two long sides of the peripheral receiving recess 215 for receiving the two guiding ribs 113 of the holding wall 111 so as to further ensure a rigid connection between the timer control device 10 and the timer adapter 20.

As shown in FIG. 5, the timer adapter 20 is designed for installing to an electrical cord 30 of any electrical appliance, such as a floor lamp, a heater, an audio system, an air conditioner, etc. According to the specific arrangement of the independent timer adapter 20 of the timing control switch of the present invention, the user may equip a plurality of timer adapters 20 with various electrical appliances respectively by connecting each timer adapter 20 to an easy accessible and convenient positions of the electrical cord 30 of each electrical appliance. The installation of the timer adapter 20 is very simple. The user can simply cut one of the power supply electrical wire 31. The two cut ends of the wire 31 are inserted into the timer adapter 20 through the two access holes 213, 214 and electrically connected with the two electrical terminals 231, 232 respectively. Another wire 32 of the electrical cord 30 just simply passes through the timer adapter 20 through the two access holes 213, 214. Then the timer adapter 20 is ready to connected with the timer control device 10 anytime.

In normal condition, the push cap 253 is in up position to keep the contact element 251 remaining in contact with both the first and second contact plates 241, 242, so that the electricity can pass through.

When the user desires to provide timer control function for any electrical appliance installed with the timer adapter 20, the user can fit and electrically connect the timer control device 10 with the timer adapter 20 by inserting the connector 17 of the timer control device 10 into the receiving chamber 22 of the timer adapter 20, wherein the pusher 171 of the timer control device 10 pushes the movable conducting means 25 away from the first and second contact plates 241, 242 so as to disconnect the electrical connection between the elongated contact element 251 and the first and second contact plates 241, 242. At the same time, the first and the second conducting element 172, 173 of the connector 17 of the timer control device 10 are electrically in contact with the first and the second contact plate 241, 242 respectively. The battery operated digital timer control device 10 is now ready to control when the electricity can or can not go through from the power supply.

When the battery operated digital timer control device 10 is unplugged from the timer adapter 20, the coil spring 254 will automatically prop up the push cap 253 to push the contact element 251 back to in contact with the first and second contact plates 241, 242 again, so that the electrical appliance is electrically connected again and can be operated in normal condition.

Figure 9:
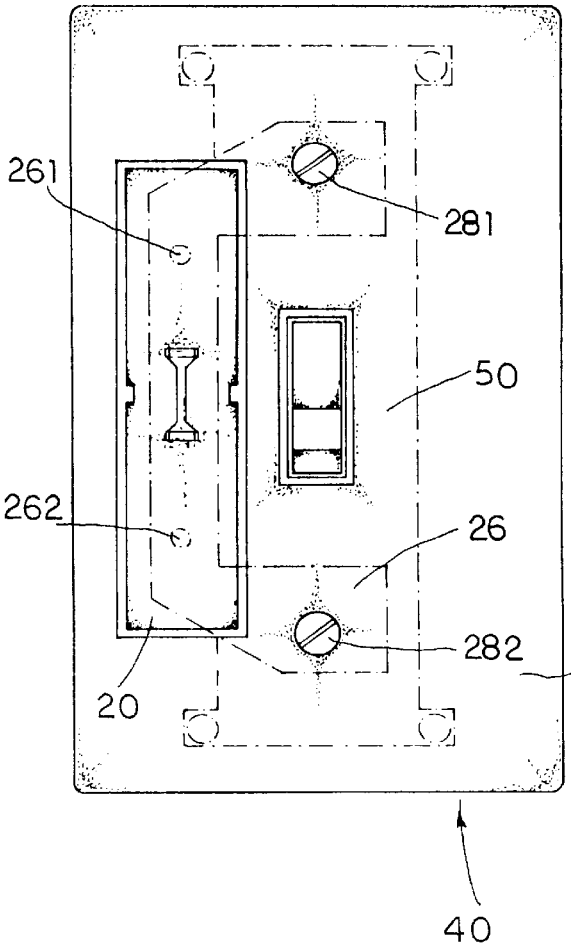
FIG. 9 is a front view of the timer adapter installed on a wall switch according to the above preferred embodiment of the present invention.
Figure 10:
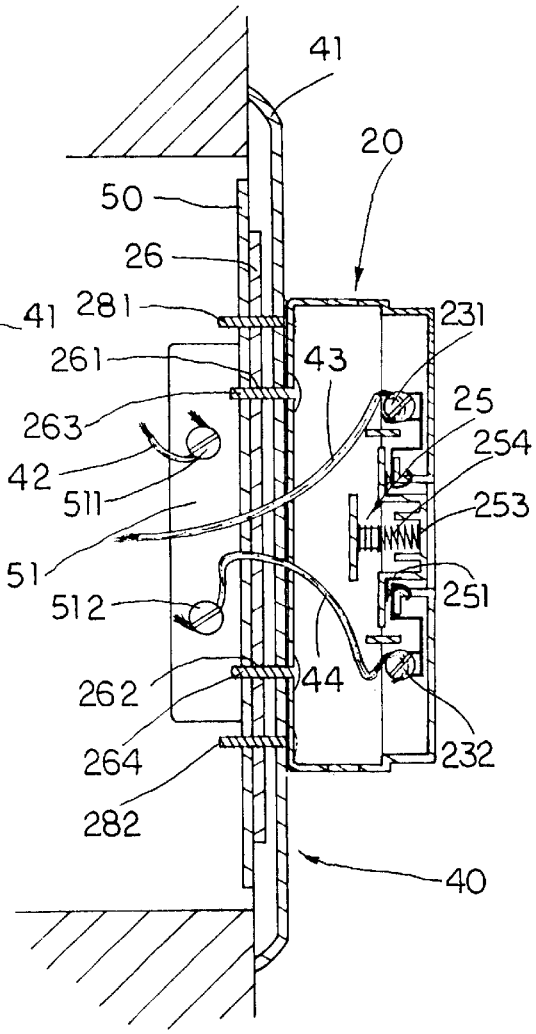
FIG. 10 is a sectional end view of the timer adapter installed on a wall switch according to the above preferred embodiment of the present invention.

Referring to FIGS. 9 and 10 of the drawing, the timer adapter 20 of the present invention is embodied as installing to a wall switch 40, in which the timer adapter 20 further comprises a mounting plate 26 with two holes 261, 262 provided thereon for securing the timer adapter 20. The mounting plate 26 is mounted in between a wall socket frame 50 and a switch plate 41 of the wall switch 40 by a set of screws 281, 282. As shown in FIG. 10, the timer adapter 20 is secured to the mounting plate 26 by screwing another set of screws 263, 264 into the holes 261, 262 respectively. For wiring, one of the power supply wire 42 remains in a first connection 511 in a switch unit 51, another wire 43 disconnected from a second connection 512 in the switch unit 51 and connect to the electrical terminal 231 of the timer adapter 20. An additional wire 44 is connected between the electrical terminal 232 and the second connection 512 in the switch unit 51. When the battery operated digital timer control device 10 is not plugged to the timer adapter 20, the wall switch 40 can be used as normal wall switch. However, when the timer control device 10 is plugged to the timer adapter 20, the push cap 253 is pushed down to disconnect the electricity connection between the power supply and the second connection 512, therefore the switch unit 51 becomes obsolete, and thus the timer control device 10 controls the on/off action for this wall switch 40.

Figure 11:
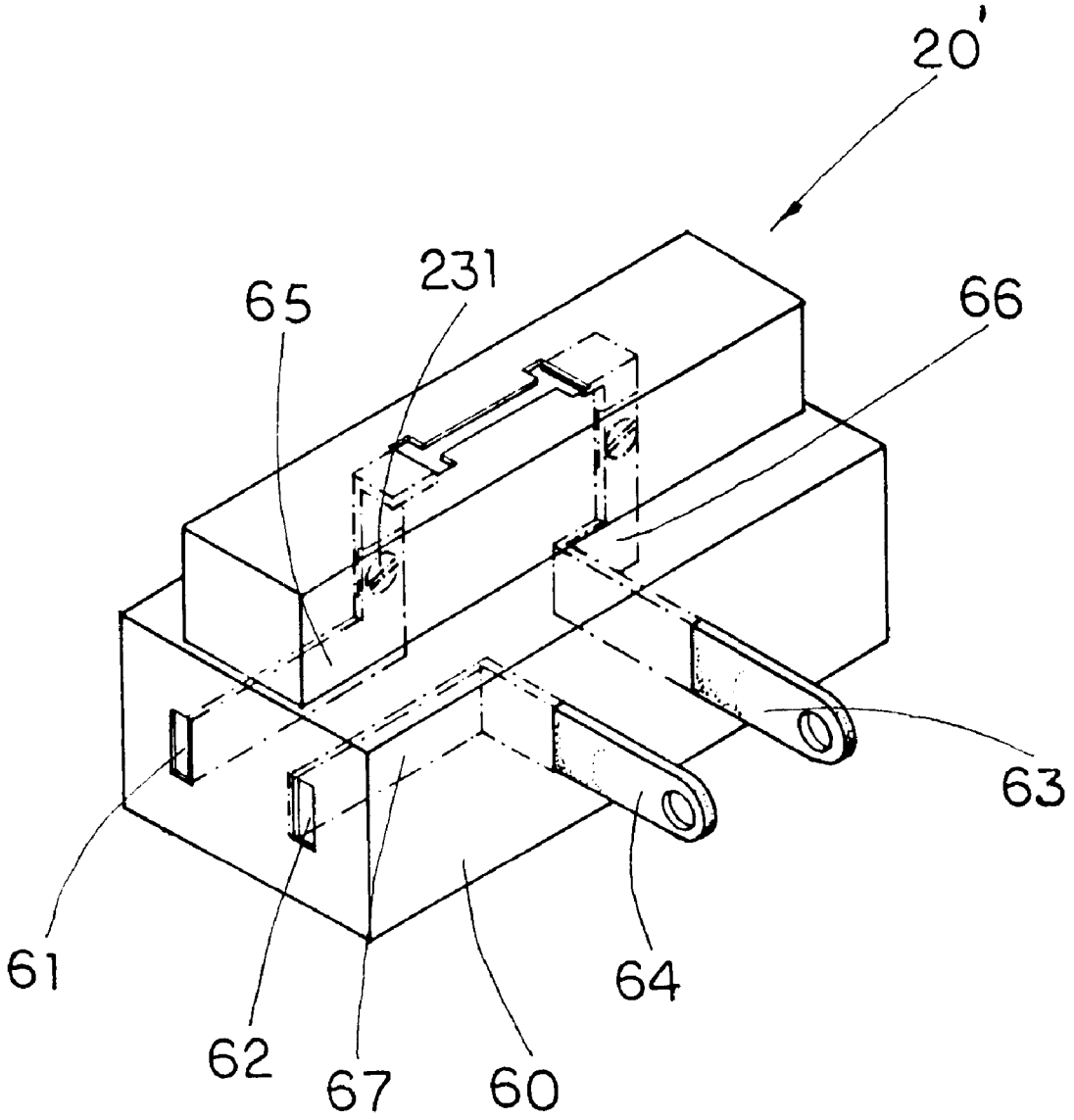
FIG. 11 is a perspective of an alternative mode of the timer adapter according to the above preferred embodiment of the present invention.

Referring to FIG. 11, an alternative mode of the timer adapter 20' is illustrated, in which the timer ready timer adapter 20' is designed as a plug-in unit. The timer adapter 20', which is designed to have a wider bottom base 60, comprises two sockets 61, 62, and two plug elements 63, 64 for plug into the wall socket outlet. The upper part of the timer adapter 20' remains the same as the above mentioned embodiment adapted for equipping with the timer control device 10 as disclosed above to plug in. The wiring of this alternative mode has a first conducting plate 65 directly connected between the first electrical terminal 23 1 and the socket 61, a second conducting plate 66 connected between the second electrical terminal 232 and the plug element 63, and a third conducting plate 67 connected between the socket 62 and the plug element 64. When the battery operated digital timer control device 10 is plugged into this alternative mode of timer adapter 20', it can be used as a plug-in type timer which plugs directly into the wall socket outlet for enabling the lighting or the appliance or the like directly plugged into the sockets 61 and 62.

In accordance with the timing control switch of the present invention as embodied above, the following advantages can be achieved.

1. The timer control device which may be functioned by selectively plugging into any one of a plurality of special designed timer adapters which are electrically equipped with the electrical cords of appliances, extension cords, plugs of appliances, socket outlets, or wall switches respectively, so as to turn lights, appliances and the like on and off at specific times preset.

2. The timer adapter may be preset on any easy-accessible and convenient location along the electrical cord, outlet, or wall switch of an appliance. Therefore, the timer control device of the present invention can be easily plugged to or unplugged from any timer adapter connected to an easy-accessible and convenient location along the electrical cord. Moreover, people do not have to move furniture or crawl under table to find the outlet behind which happened in most cases if using the conventional timer device.

3. The timer control device can be easily switched to one and another timer adapters where needed.

4. When the timing control switch is not used as a timer control purpose, it can be used as a digital clock and alarm/clock unit.

5. The battery-operated timer control device will not be affected in electrical power failure which normally will mess up the preset time of the conventional timer device or AC powered timer unit, because the timer control device of the present invention comprises a battery as its power source.

I claim:

1. A timing control switch, comprising a timer control device which comprises a housing, a DC power source, a timer control circuitry, a driving device, a driver, a connecting bridge, and a connector, in which said DC power source is installed inside said housing for providing electrical power for said timer control circuitry and said driving device, said connector comprising a pusher and a first and a second electrical conducting element extended outwardly and independently from a connecting end of said housing, said timer control circuitry being disposed inside said housing for time presetting and computing, said driving device being installed inside said housing and electrically connected with said timer control circuitry, said connecting bridge being disposed inside said housing and having an electrical conductive connecting plate which has a length at least equal to a distance between said first element and said second conducting element, said driver being connected between said driving device and said connecting bridge, so that when a preset on-time in said timer control circuitry is up, said timer control circuitry generates a connecting signal to activate said driving device to drive said driver toward said first and second conducting elements so as to press said connecting plate of said connecting bridge to electrically connect between said first conducting element and said second conducting element, and that when a preset off time in said timer control circuitry is up, said timer control circuitry generates a disconnecting signal to activate said driving device to drive said driver away from said first and second conducting elements so as to draw said connecting plate of said connecting bridge to electrically disconnect with said first conducting element and said second conducting element; and at least a timer adapter which comprises a case having a receiving chamber for receiving said connector of said timer control device, a first and a second electrical terminal provided inside said case for electrically connecting with two electrical cord ends of an electrical appliance respectively, a first and a second electrical conductive contact plate extending from said first and said second electrical terminal to said receiving chamber respectively, and a movable conducting means which is disposed within said receiving chamber and comprises an electrical conductive elongated contact element normally in contact with said first and second contact plates, wherein said timer control device is fittedly and electrically connected with said timer adapter by inserting said connector of timer control device into said receiving chamber of said timer adapter, wherein said pusher of said timer control device pushes said movable conducting means away from said first and second contact plates so as to disconnect said electrical connection between said elongated contact element and said first and second contact plates, and that, at the same time, said first and said second conduct element of said connector of said timer control device are electrically in contact with said first and said second contact plate respectively;

wherein said driving device comprises a small reversible electrical DC motor affixed in said housing and an output gear shaft and a guiding holder affixed in said housing for supporting said driver and preventing said driver from rotation, wherein said gear shaft is driven to rotate by said DC motor which is powered by at least a battery, said DC motor being controlled by said timer control circuitry, to which said DC motor is electrically connected;

wherein said guiding holder has a guiding channel aligned coaxially with said gear shaft, said guiding channel having at least two axial side slots provided on two opposite sides thereof respectively, said driver comprising a driver shaft penetrating through said guiding channel and a driver seat affixed to a first end of said driver shaft for loosely interlocking with said connecting bridge, a second end of said driver shaft having an axial gear hole engaging with said gear shaft of said driving device, said driver shaft protruding two opposite longitudinal side guiders slidably wedging along said two side slots of said guiding holder respectively;

wherein said driver seat provides two recesses at two ends thereof respectively, said connecting bridge further comprising two guiding posts extended through said two recesses of said driver seat respectively, a spring element being positioned between said driver seat and said connecting bridge for providing a pressing force on said connecting bridge so as to ensure a good electrical contact between said connecting plate and said first and second conducting elements.

2. A timing control switch, as recited in claim 1, in which said timer control device further comprises a first and a second power interrupter, said first power interrupter being attached to said inner surface of said connecting end of said housing, said second power interrupter being attached to a battery case of said battery above said connecting end of said housing so as to define a predetermined distance between said first and said second power interrupter, said driver seat of said driver further having a first and a second prong protruded outwardly from said two ends of said driver seat respectively, thereby when said driver seat and said driver shaft are driven to move forward by said rotating gear shaft until said first prong reaches said first power interrupter, said DC motor stops and said driver remains in a low position to keep said connecting plate in contact with said first and second conducting elements, however when said driver is driven to move rearward by said rotating gear shaft until said second prong reaches said second power interrupter, said DC motor stops and said driver remain in an up position to keep said connecting plate disconnecting with said first and second conducting elements.

3. A timing control switch, as recited in claim 2, in which said first and second conducting elements are two electrical conductive plug blades parallelly affixed to said connecting end of said housing, each of said first and second conducting elements has a transversal contact lip extended on an inner surface of said connecting end, said pusher comprising a rectangular rib protruded from said connecting end between said first and second conducting elements.

4. A timing control switch, as recited in claim 3, in which said conducting means of said timer adapter comprises a supporting wall transversally extended from a side wall of said case, a push cap normally disposed within said receiving chamber, and a coil spring connected between said supporting wall and said push cap, wherein said push cap is propped up by means of said coil spring to ensure said contact element being in good contact with said first and second contact plates respectively in normal condition, wherein said push cap defines two side sockets between two side walls of said receiving chamber and said push cap, a I-shaped opening being provided on a top-wall of said case, which has two end holes linked to said two side sockets respectively and a central rectangular hole positioned between said two end holes, wherein said two side sockets are adapted for receiving said first and second conducting elements of said timer control device via said two end holes respectively, said central rectangular hole having a length and a width at least equal to that of said pusher of said connector of said timer control device, so that when said first and second conducting elements of said timer control device is plugged into said two side sockets, said push cap is down pressed by said pusher to drive said contact element disconnecting with said first and second contact plates, and that said contact element comprises a ring portion retained on said push cap and two end terminals extended from said ring portion adapted for contacting with said first and second contact plates respectively, wherein said case has two access holes formed at two side walls of said case respectively to enable said electrical cord to insert into said timer adapter therethrough.

5. A timing control switch, as recited in claim 4, in which said housing has a peripheral holding wall peripherally extended from said connecting end of said housing, a peripheral receiving recess being formed around said top wall of said case, wherein said holding wall of said housing of said timer control device is sat on said peripheral receiving recess to firmly support said timer control device on said timer adapter when said connector of said timer control device is inserted into said receiving chamber of said timer adapter, wherein two guiding ribs are longitudinally protruded from said central positions of said two long sides of said holding wall respectively, and that two indented slots are formed on said central portions of two long sides of said peripheral receiving recess respectively for receiving said two guiding ribs of said holding wall so as to further ensure a rigid connection between said timer control device and said timer adapter.

6. A timing control switch, as recited in claim 5, in which said timer adapter is equipped with a wall switch, wherein said timer adapter further comprises a mounting plate for securing said timer adapter in position, said mounting plate being mounted in between a wall socket frame and a switch plate of said wall switch, one of two power supply wires of said wall switch remaining in a first connection in a switch unit of said wall switch, another power supply wire being disconnected from a second connection in said switch unit of said wall switch and connected to said first electrical terminal of said timer adapter, wherein an additional wire is connected between said second electrical terminal and said second connection in said switch unit, thereby when said timer control device is not plugged to said timer adapter, said wall switch is used as normal, and that when said timer control device is plugged to said timer adapter, said push cap is pushed down to disconnect an electricity connection between said power supply and said second connection, therefore said switch unit becomes obsolete, and thus said timer control device controls an on/off action for said wall switch.

7. A timing control switch, as recited in claim 4, in which said timer adapter further comprises a bottom base which has a first and a second socket and a first and a second plug element, said timer adapter further comprising a first conducting plate directly connected between said first electrical terminal and said first socket, a second conducting plate connected between said second electrical terminal and said first plug element, and a third conducting plate connected between said second socket and said second plug element.

8. A timing control switch, comprising a timer control device which comprises a housing, a DC power source, a timer control circuitry, a driving device, a driver, a connecting bridge, and a connector, in which said DC power source is installed inside said housing for providing electrical power for said timer control circuitry and said driving device, said connector comprising a pusher and a first and a second electrical conducting element extended outwardly and independently from a connecting end of said housing, said timer control circuitry being disposed inside said housing for time presetting and computing, said driving device being installed inside said housing and electrically connected with said timer control circuitry, said connecting bridge being disposed inside said housing and having an electrical conductive connecting plate which has a length at least equal to a distance between said first element and said second conducting element, said driver being connected between said driving device and said connecting bridge, so that when a preset on-time in said timer control circuitry is up, said timer control circuitry generates a connecting signal to activate said driving device to drive said driver toward said first and second conducting elements so as to press said connecting plate of said connecting bridge to electrically connect between said first conducting element and said second conducting element, and that when a preset off time in said timer control circuitry is up, said timer control circuitry generates a disconnecting signal to activate said driving device to drive said driver away from said first and second conducting elements so as to draw said connecting plate of said connecting bridge to electrically disconnect with said first conducting element and said second conducting element; and at least a timer adapter which comprises a case having a receiving chamber for receiving said connector of said timer control device, a first and a second electrical terminal provided inside said case for electrically connecting with two electrical cord ends of an electrical appliance respectively, a first and a second electrical conductive contact plate extending from said first and said second electrical terminal to said receiving chamber respectively, and a movable conducting means which is disposed within said receiving chamber and comprises an electrical conductive elongated contact element normally in contact with said first and second contact plates, wherein said timer control device is fittedly and electrically connected with said timer adapter by inserting said connector of timer control device into said receiving chamber of said timer adapter, wherein said pusher of said timer control device pushes said movable conducting means away from said first and second contact plates so as to disconnect said electrical connection between said elongated contact element and said first and second contact plates, and that, at the same time, said first and said second conduct element of said connector of said timer control device are electrically in contact with said first and said second contact plate respectively;

wherein said conducting means of said timer adapter comprises a supporting wall transversally extended from a side wall of said case, a push cap normally disposed within said receiving chamber, and a coil spring connected between said supporting wall and said push cap, whereby said push cap is propped up by means of said coil spring to ensure said contact element being in good contact with said first and second contact plates respectively in normal condition.

9. A timing control switch, as recited in claim 8, in which said push cap defines two side sockets between two side walls of said receiving chamber and said push cap, a I-shaped opening being provided on a top wall of said case, which has two end holes linked to said two side sockets respectively and a central rectangular hole positioned between said two end holes, wherein said two side sockets are adapted for receiving said first and second conducting elements of said timer control device via said two end holes respectively, said central rectangular hole having a length and a width at least equal to that of said pusher of said connector of said timer control device, so that when said first and second conducting elements of said timer control device is plugged into said two side sockets, said push cap is down pressed by said pusher to drive said contact element disconnecting with said first and second contact plates.

10. A timing control switch, as recited in claim 9, in which said contact element comprises a ring portion retained on said push cap and two end terminals extended from said ring portion adapted for contacting with said first and second contact plates respectively.

11. A timing control switch, as recited in claim 10, in which said case has two access holes formed at two side walls of said case respectively to enable said electrical cord to insert into said timer adapter therethrough.

12. A timing control switch, comprising a timer control device which comprises a housing, a DC power source, a timer control circuitry, a driving device, a driver, a connecting bridge, and a connector, in which said DC power source is installed inside said housing for providing electrical power for said timer control circuitry and said driving device, said connector comprising a pusher and a first and a second electrical conducting element extended outwardly and independently from a connecting end of said housing, said timer control circuitry being disposed inside said housing for time presetting and computing, said driving device being installed inside said housing and electrically connected with said timer control circuitry, said connecting bridge being disposed inside said housing and having an electrical conductive connecting plate which has a length at least equal to a distance between said first element and said second conducting element, said driver being connected between said driving device and said connecting bridge, so that when a preset on-time in said timer control circuitry is up, said timer control circuitry generates a connecting signal to activate said driving device to drive said driver toward said first and second conducting elements so as to press said connecting plate of said connecting bridge to electrically connect between said first conducting element and said second conducting element, and that when a preset off time in said timer control circuitry is up, said timer control circuitry generates a disconnecting signal to activate said driving device to drive said driver away from said first and second conducting elements so as to draw said connecting plate of said connecting bridge to electrically disconnect with said first conducting element and said second conducting element; and at least a timer adapter which comprises a case having a receiving chamber for receiving said connector of said timer control device, a first and a second electrical terminal provided inside said case for electrically connecting with two electrical cord ends of an electrical appliance respectively, a first and a second electrical conductive contact plate extending from said first and said second electrical terminal to said receiving chamber respectively, and a movable conducting means which is disposed within said receiving chamber and comprises an electrical conductive elongated contact element normally in contact with said first and second contact plates, wherein said timer control device is fittedly and electrically connected with said timer adapter by inserting said connector of timer control device into said receiving chamber of said timer adapter, wherein said pusher of said timer control device pushes said movable conducting means away from said first and second contact plates so as to disconnect said electrical connection between said elongated contact element and said first and second contact plates, and that, at the same time, said first and said second conduct element of said connector of said timer control device are electrically in contact with said first and said second contact plate respectively;

wherein said housing has a peripheral holding wall peripherally extended from said connecting end of said housing, a peripheral receiving recess being formed around a top wall of said case, wherein said holding wall of said housing of said timer control device is sat on said peripheral receiving recess to firmly support said timer control device on said timer adapter when said connector of said timer control device is inserted into said receiving chamber of said timer adapter.

13. A timing control switch, as recited in claim 12, in which two guiding ribs are longitudinally protruded from said central positions of said two long sides of said holding wall respectively, and two indented slots are formed on said central portions of two long sides of said peripheral receiving recess respectively for receiving said two guiding ribs of said holding wall so as to further ensure a rigid connection between said timer control device and said timer adapter.

* * * * *